US008176891B2

(12) United States Patent
Choi

(10) Patent No.: US 8,176,891 B2
(45) Date of Patent: May 15, 2012

(54) MULTI-CYLINDER ENGINE

(75) Inventor: Byong Young Choi, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 482 days.

(21) Appl. No.: 12/426,056

(22) Filed: Apr. 17, 2009

(65) Prior Publication Data

US 2009/0314248 A1 Dec. 24, 2009

(30) Foreign Application Priority Data

Jun. 19, 2008 (KR) ..... 10-2008-0058011

(51) Int. Cl.
*F02D 13/06* (2006.01)
*F02D 17/02* (2006.01)

(52) U.S. Cl. ..... 123/198 F; 123/197.4; 74/595

(58) Field of Classification Search ..... 123/198 F, 123/197.4; 74/595
See application file for complete search history.

(56) References Cited

U.S. PATENT DOCUMENTS

| | | | | |
|---|---|---|---|---|
| 1,911,874 | A * | 5/1933 | Barkeij | 123/54.7 |
| 5,042,444 | A * | 8/1991 | Hayes et al. | 123/335 |
| 6,138,636 | A * | 10/2000 | Kohno et al. | 123/198 F |
| 6,588,392 | B2 * | 7/2003 | Armstrong et al. | 123/192.1 |
| 6,786,190 | B2 * | 9/2004 | Wu et al. | 123/198 F |
| 6,907,871 | B2 * | 6/2005 | Fukusako et al. | 123/594 |
| 7,104,244 | B2 * | 9/2006 | Nishi et al. | 123/198 F |
| 7,308,959 | B2 * | 12/2007 | Roberts | 180/65.31 |
| 7,314,034 | B1 * | 1/2008 | Waters et al. | 123/198 F |
| 7,328,686 | B2 * | 2/2008 | Cullen | 123/325 |
| 7,343,902 | B2 * | 3/2008 | Brevick et al. | 123/481 |
| 7,357,019 | B2 * | 4/2008 | McDonald et al. | 73/114.58 |
| 7,360,356 | B2 * | 4/2008 | Narita et al. | 60/285 |
| 7,503,296 | B2 * | 3/2009 | Rozario et al. | 123/90.16 |
| 7,610,903 | B2 * | 11/2009 | Maehara et al. | 123/481 |
| 2006/0130814 | A1 * | 6/2006 | Bolander et al. | 123/481 |

FOREIGN PATENT DOCUMENTS

KR 10-0508173 B1 8/2005

* cited by examiner

*Primary Examiner* — Noah Kamen
*Assistant Examiner* — Grant Moubry
(74) *Attorney, Agent, or Firm* — Morgan, Lewis & Bockius LLP

(57) ABSTRACT

A multi-cylinder engine with a plurality of cylinders may include at least one variable cylinder that performs a power stroke or is deactivated, normal cylinders that perform power strokes at equal rotation intervals, and a control portion that activates or deactivates the at least one variable cylinder according to a predetermined load condition, wherein deactivation position of the at least one variable cylinder is determined based on rotation angle of a crankshaft.

15 Claims, 6 Drawing Sheets

FIG. 3
(A)
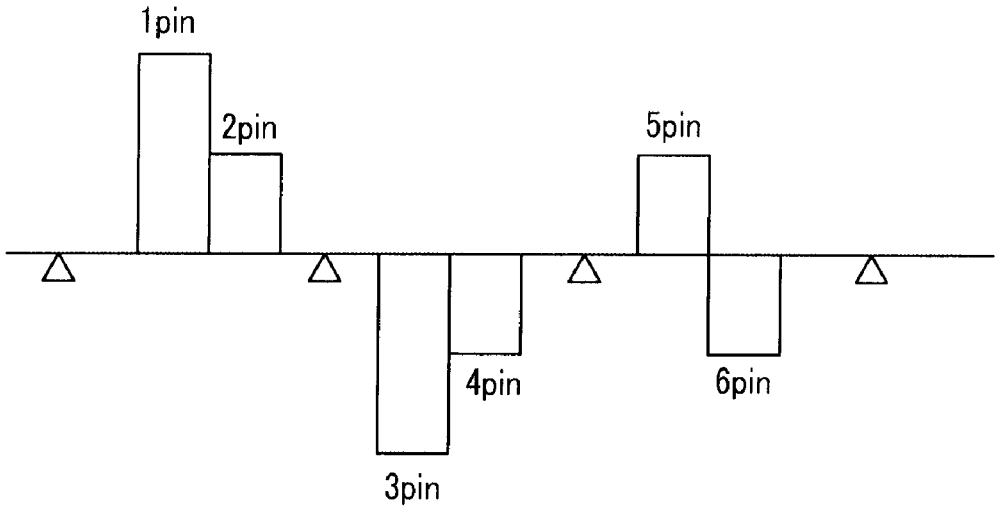
Side view
(B)
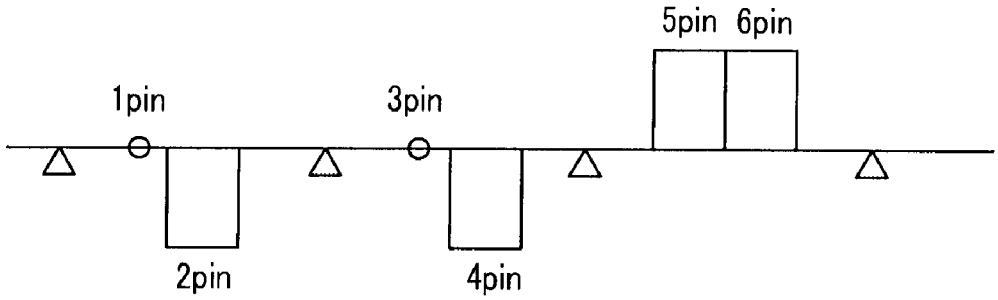
Top view

FIG. 4

(A) 1cyl $\xrightarrow{180^\circ}$ 6cyl $\xrightarrow{180^\circ}$ 2cyl $\xrightarrow{180^\circ}$ 3cyl (B) 1cyl $\xrightarrow{180^\circ}$ 3cyl $\xrightarrow{180^\circ}$ 2cyl $\xrightarrow{180^\circ}$ 6cyl (C) 1cyl $\xrightarrow{60^\circ}$ 5cyl $\xrightarrow{120^\circ}$ 6cyl $\xrightarrow{120^\circ}$ 4cyl $\xrightarrow{60^\circ}$ 2cyl $\xrightarrow{180^\circ}$ 3cyl (D) 1cyl $\xrightarrow{60^\circ}$ 5cyl $\xrightarrow{120^\circ}$ 3cyl $\xrightarrow{120^\circ}$ 4cyl $\xrightarrow{60^\circ}$ 2cyl $\xrightarrow{180^\circ}$ 6cyl

MULTI-CYLINDER ENGINE

CROSS-REFERENCE TO RELATED APPLICATION

The present application claims priority to Korean Patent Application No. 10-2008-0058011 filed on Jun. 19, 2008, the entire contents of which are incorporated herein for all purposes by this reference.

BACKGROUND OF THE INVENTION

1. Field of the Invention

The present invention relates to a multi-cylinder engine, and more particularly to a multi-cylinder engine for improving a vibration characteristic and for reducing fuel consumption.

2. Description of Related Art

Generally, the firing order of a six-cylinder engine is a first cylinder, a second cylinder, a third cylinder, a fourth cylinder, a fifth cylinder, and a sixth cylinder, and the respective intervals of firing is 120 degrees of crankshaft rotation angle.

When a cylinder de-activation mode is operated, three cylinders sequentially perform power strokes.

However, when the three cylinders are operating, an unpleasant vibration that is unacceptable in a high-class vehicle is generated. Further, when the engine is in the cylinder de-activation mode, the power of the engine is low and the fuel consumption is relatively high.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a multi-cylinder engine having advantages of reduced vibration and fuel consumption during a deactivated period of at least one cylinder.

In an aspect of the present invention, a multi-cylinder engine with a plurality of cylinders may include at least one variable cylinder that performs a power stroke or is deactivated, normal cylinders that perform power strokes at equal rotation intervals, and a control portion that activates or deactivates the at least one variable cylinder according to a predetermined load condition, wherein deactivation position of the at least one variable cylinder is determined based on rotation angle of a crankshaft.

Crankpins of the normal cylinders may be disposed symmetrically with respect to a line that connects a crankpin of the at least a variable cylinder and a rotation center of the crankshaft.

The crankpins of the normal cylinders and the variable cylinders may be disposed approximately with an equal rotation angle therebetween about the rotation center of the crankshaft.

The normal cylinders may perform the power strokes symmetrically in time order with respect to the line that connects the crankpins of the variable cylinders and the rotation center of the crankshaft.

The normal cylinders may include four cylinders that perform power strokes with equal rotation intervals of 180 degrees in a rotating direction of the crankshaft.

In another aspect of the present invention, the variable cylinders and the normal cylinders may include a first cylinder, a second cylinder, a third cylinder, a fourth cylinder, a fifth cylinder, and a sixth cylinder, wherein a first crankpin corresponding to the first cylinder, a second crankpin corresponding to the second cylinder, a third crankpin corresponding to the third cylinder, a fourth crankpin corresponding to the fourth cylinder, a fifth crankpin corresponding to the fifth cylinder, and a sixth crankpin corresponding to the sixth cylinder are disposed, and the first crankpin, the second crankpin, the fourth crankpin, the third crankpin, the sixth crankpin, and the fifth crankpin are disposed sequentially in a rotating direction of the crankshaft with an uniform rotation angle therebetween.

The crankpins of the fourth and fifth cylinders may be disposed approximately with 180 degrees therebetween about a rotation center of the crankshaft, wherein the fourth and fifth cylinders are the variable cylinders.

The fourth and fifth cylinders may perform power strokes with rotation intervals of 240 degrees in a rotating direction of the crankshaft.

The crankpins of the first, second, third, and sixth cylinders may be disposed symmetrically with respect to a line that connects the crankpins of the fourth and fifth cylinders about a rotation center of the crankshaft.

The first cylinder, the sixth cylinder, the second cylinder, and the third cylinder may sequentially perform power strokes with equal rotation intervals of 180 degrees, wherein the fifth cylinder and the fourth cylinder are selectively deactivated.

The fifth cylinder may perform a power stroke between the power stroke of the first cylinder and the power stroke of the sixth cylinder, and the fourth cylinder performs a power stroke between the power stroke of the sixth cylinder and the power stroke of the second cylinder.

The power stroke of the fifth cylinder may have a rotation difference of 60 degrees compared with the power stroke of the first cylinder and the power stroke of the fourth cylinder has a rotation difference of 120 degrees compared with the power stroke of the sixth cylinder.

In further another aspect of the present invention, the multi-cylinder engine may further include a valve deactivation portion for controlling intake/exhaust valves that are disposed at the at least one variable cylinder, and an injector for injecting fuel, wherein the control portion deactivates the variable cylinder by controlling the valve deactivation portion and the injector wherein the injector directly injects gasoline or diesel into the cylinder.

In still further another aspect of the present invention, the multi-cylinder engine with a plurality of cylinders may include a first bank including at least one variable cylinder that performs a power stroke or is deactivated and at least one normal cylinder a second bank including at least one variable cylinder that performs a power stroke or is deactivated and at least one normal cylinder and a control portion that activates or deactivates the at least one variable cylinder according to a predetermined load condition, wherein the normal cylinders perform power strokes at equal rotation intervals, and wherein deactivation position of the at least one variable cylinder is determined based on rotation angle of a crankshaft.

The variable cylinders and the normal cylinders may include a first cylinder, a second cylinder, a third cylinder, a fourth cylinder, a fifth cylinder, and a sixth cylinder, and a first, second, third, fourth, fifth and sixth crankpins are configured to correspond to the first, second, third, fourth, fifth and sixth cylinders respectively, and wherein the first crankpin, the second crankpin, the fourth crankpin, the third crankpin, the sixth crankpin, and the fifth crankpin are disposed sequentially in a rotating direction of the crankshaft with a uniform rotation angle therebetween.

The crankpins of the fourth and fifth cylinders may be disposed approximately with 180 degrees therebetween about a rotation center of the crankshaft, and wherein the fourth and fifth cylinders are the variable cylinders respectively in the first bank and the second bank, wherein the second and sixth cylinders are disposed in the first bank and the first and fifth cylinders are disposed in the second bank.

The fourth and fifth cylinders may perform power strokes with rotation intervals of 240 degrees in a rotating direction of the crankshaft.

As stated above, in the multi-cylinder engine according to the present invention, except the deactivated cylinder, the other cylinders perform power strokes at equal intervals so that the vibration and fuel consumption can be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIG. 3 schematically shows a crankpin that is mounted on an exemplary six-cylinder engine according to the present invention.

FIG. 4 is a chart showing a power stroke sequence of an exemplary six-cylinder engine according to the present invention.

Figure 1:
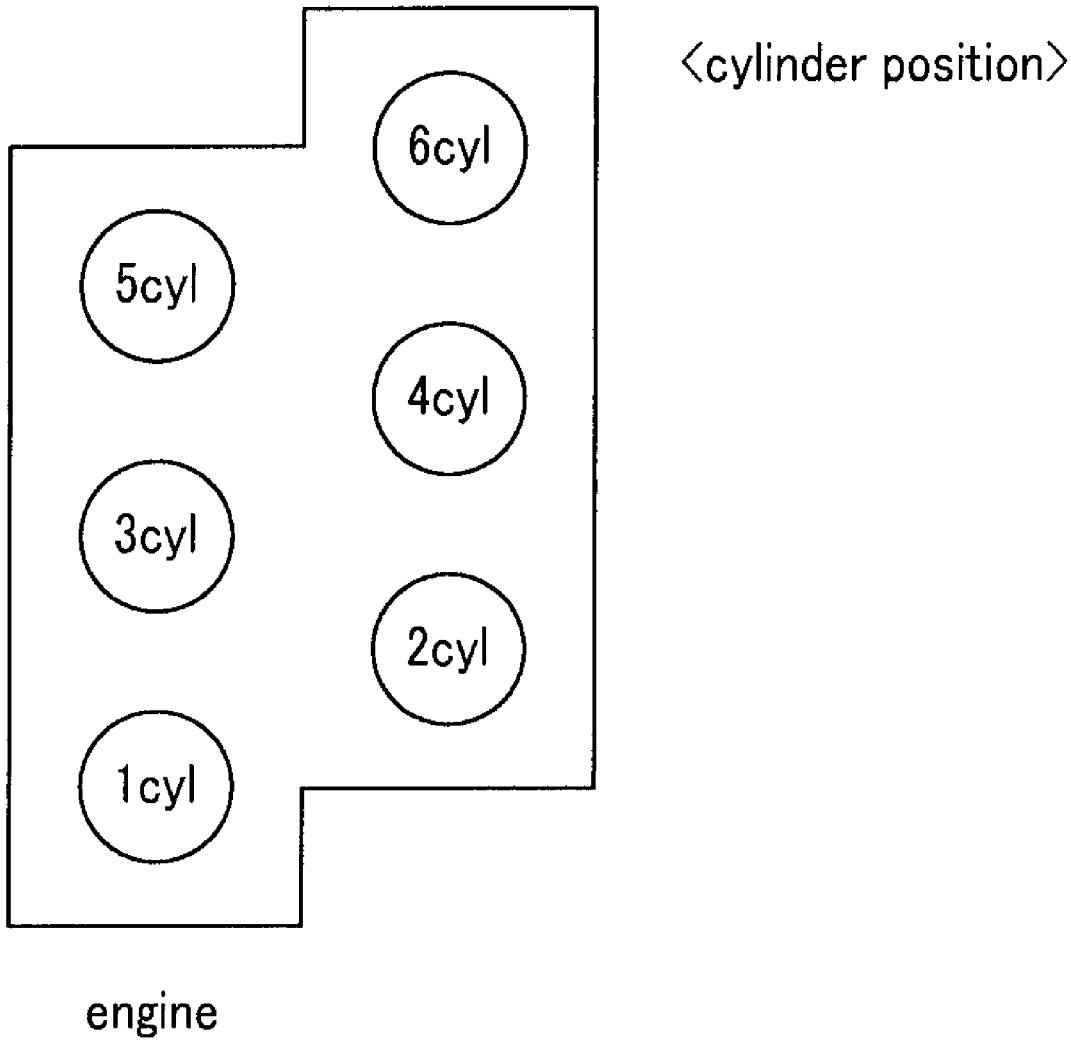
FIG. 1 is a schematic top plan view showing a cylinder arrangement of an exemplary six-cylinder engine according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Various embodiments of the present invention will hereinafter be described in detail with reference to the accompanying drawings.

According to various embodiments of the present invention, although a six-cylinder engine is hereinafter explained, this invention can be applied to a four-cylinder engine, an eight-cylinder engine, a ten-cylinder engine, a twelve-cylinder engine, and so on, as stated in the title of the invention above.

FIG. 1 is a schematic top plan view showing a cylinder arrangement of a six-cylinder engine according to various embodiments of the present invention.

Referring to FIG. 1, a six-cylinder engine includes a first cylinder (1 cyl), a second cylinder (2 cyl), a third cylinder (3 cyl), a fourth cylinder (4 cyl), a fifth cylinder (5 cyl), and a sixth cylinder (6 cyl).

The first, third, and fifth cylinders (1, 3, and 5 cyl) are disposed in line and the second, fourth, and sixth cylinders (2, 4, and 6 cyl) are disposed in line corresponding to the forgoing cylinders (1, 3, and 5 cyl).

Figure 2:
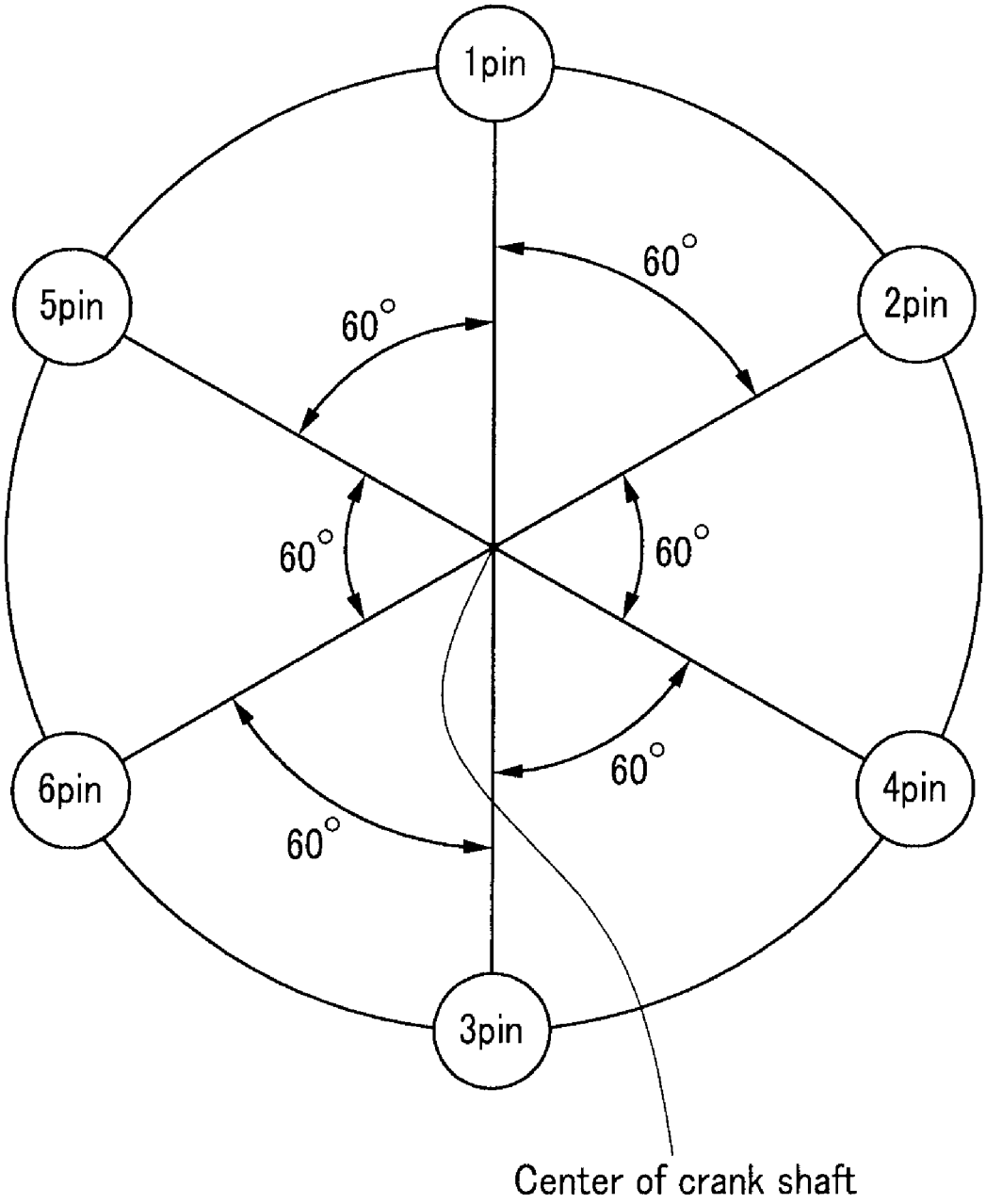
FIG. 2 is a schematic side view of a crankpin that is mounted on an exemplary six-cylinder engine according to the present invention.

FIG. 2 is a schematic side view of a crankpin that is mounted on a six-cylinder engine according to various embodiments of the present invention.

Referring to FIG. 2, crankpins are disposed around the crankshaft and a six-cylinder engine according to various embodiments of the present invention includes a first crankpin (1 pin) that is disposed corresponding to the first cylinder (1 cyl), a second crankpin (2 pin) that is disposed corresponding to the second cylinder (2 cyl), a third crankpin (3 pin) that is disposed corresponding to the third cylinder (3 cyl), a fourth crankpin (4 pin) that is disposed corresponding to the fourth cylinder (4 cyl), a fifth crankpin (5 pin) that is disposed corresponding to the fifth cylinder (5 cyl), and a sixth crankpin (6 pin) that is disposed corresponding to the sixth cylinder (6 cyl).

Further, FIG. 2 shows that the first, second, third, fourth, fifth, and sixth crankpins (1, 2, 3, 4, 5, and 6 pin) are disposed centering around the rotation center of the crankshaft. As shown, the first crankpin (1 pin) is disposed at an upper side and the second, fourth, third, sixth, and fifth crankpins (2, 4, 3, 6, and 5 pin) are sequentially disposed in a clockwise direction. Particularly, the crankpins (1, 2, 4, 3, 6, and 5 pin) have uniform intervals of 60 degrees in sequence.

The crankpins (1, 2, 4, 3, 6, and 5 pin) are disposed around the rotation center of the crankshaft at equal intervals such that the balance and the vibration characteristic can be improved. Also, the distance between two pins can be minimized, the stiffness of the crankshaft can be increased, and the weight thereof can be reduced.

FIG. 3 schematically shows a crankpin that is mounted on a six-cylinder engine according to various embodiments of the present invention.

FIG. 3(A) is a schematic side-view of a crankshaft and FIG. 3(B) is a top plan view of a crankshaft.

As shown, the first, second, third, fourth, fifth, and sixth cylinders (1, 2, 3, 4, 5, and 6 cyl) are not overlapped to be sequentially disposed with a predetermined gap in a length direction of the crankshaft. Further, they are symmetrically disposed based on the center axis line of the crankshaft such that the vibration characteristics can be improved.

FIG. 4 is a chart showing a power stroke sequence of a six-cylinder engine according to various embodiments of the present invention.

Referring to FIG. 4(A), in a six-cylinder engine according to various embodiments of the present invention, the first cylinder (1 cyl), the sixth cylinder (6 cyl), the second cylinder (2 cyl), and the third cylinder (3 cyl) sequentially performs the power strokes, wherein the respective rotation intervals are 180 degrees.

The first, second, third and sixth cylinders (1, 2, 3, 6 cyl) perform the power strokes at equal intervals of 180 degrees, and the fourth and fifth cylinders (4 and 5 cyl) are deactivated in an exemplary embodiment of the present invention.

Particularly, when the load of the engine is lower than a predetermined value, the fourth and fifth cylinders (4 and 5 cyl) are deactivated, and when the load of the engine is higher than a predetermined value, the fourth and fifth cylinders (4 and 5 cyl) are normally operated to perform the power strokes.

When the load of the engine is low, the four cylinders perform the power stroke at equal intervals such that the vibration and the noise thereof can be reduced.

Further, if the engine load is high, all six cylinders perform the power strokes at different intervals, but due to the high rotation speed of the crankshaft in the high load state, it is hard for the driver to feel the vibration problems.

Referring to FIG. 4(B), in a six-cylinder engine according to various embodiments of the present invention, the first cylinder (1 cyl), the third cylinder (3 cyl), the second cylinder (2 cyl), and the sixth cylinder (6 cyl) sequentially perform power strokes, wherein the rotation intervals are equally 180 degrees. In this case, the power stroke interval between the fifth and fourth cylinders (5 and 4 cyl) is 240 degrees.

Referring to FIG. 4(C), in a six-cylinder engine according to various embodiments of the present invention, the first cylinder (1 cyl), the fifth cylinder (5 cyl), the sixth cylinder (6 cyl), the fourth cylinder (4 cyl), the second cylinder (2 cyl) and the third cylinder (3 cyl) sequentially perform power strokes.

In this case, the power stroke interval between the first and fifth cylinders (1 and 5 cyl) is 60 degrees, the power stroke interval between the fifth and sixth cylinders (5 and 6 cyl) is 120 degrees, the power stroke interval between the sixth and fourth cylinders (6 and 4 cyl) is 120 degrees, the power stroke interval between the fourth and second cylinders (4 and 2 cyl) is 60 degrees, and the power stroke interval between the second and third cylinders (2 and 3 cyl) is 180 degrees. In this case, the power stroke interval between the fifth and fourth cylinders (5 and 6 cyl) is 240 degrees.

Referring to FIG. 4(D), in a six-cylinder engine according to various embodiments of the present invention, the first cylinder (1 cyl), the fifth cylinder (5 cyl), the third cylinder (3 cyl), the fourth cylinder (4 cyl), the second cylinder (2 cyl), and the sixth cylinder (6 cyl) sequentially perform power strokes, wherein the power stroke intervals are respectively 60, 120, 120, 60, and 180 degrees.

Figure 5:
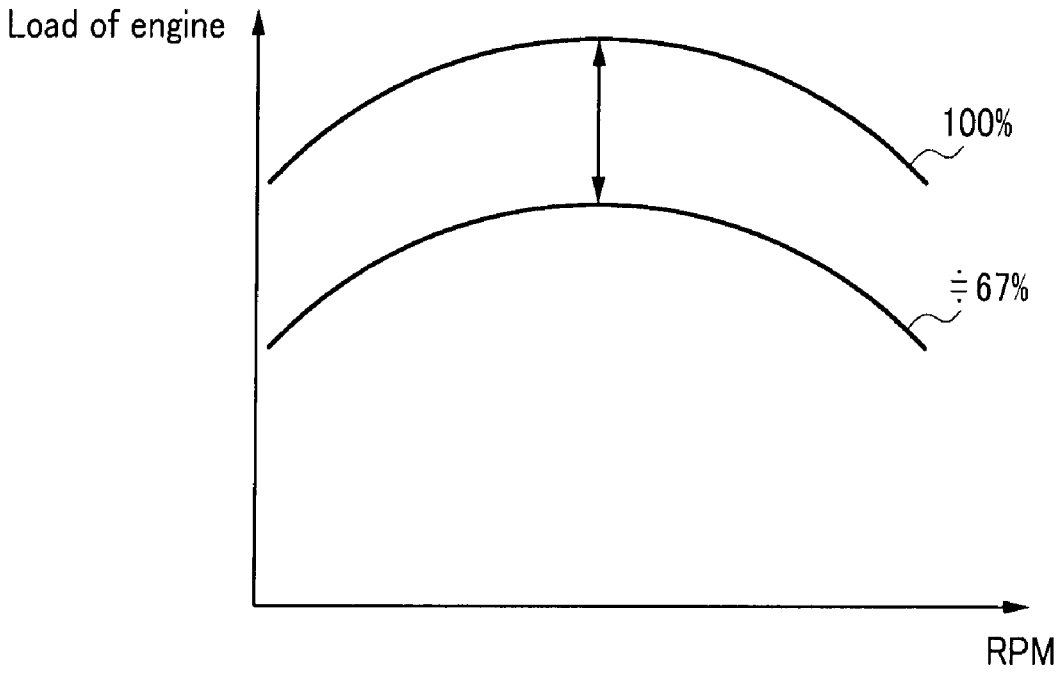
FIG. 5 is a table showing load value of an exemplary six-cylinder engine according to the present invention.

FIG. 5 is a table showing load value of a six-cylinder engine according to various embodiments of the present invention.

Referring to FIG. 5, when all six cylinders are operated, 100% of power can be generated, and when the four cylinders are operated, about 67% of power can be generated.

As described above, when the four cylinders operate in a low load condition at equal intervals, the vibration characteristic is improved and the fuel consumption can be reduced, and when the six cylinders operate in a high load condition, the high power can be effectively achieved.

Figure 6:
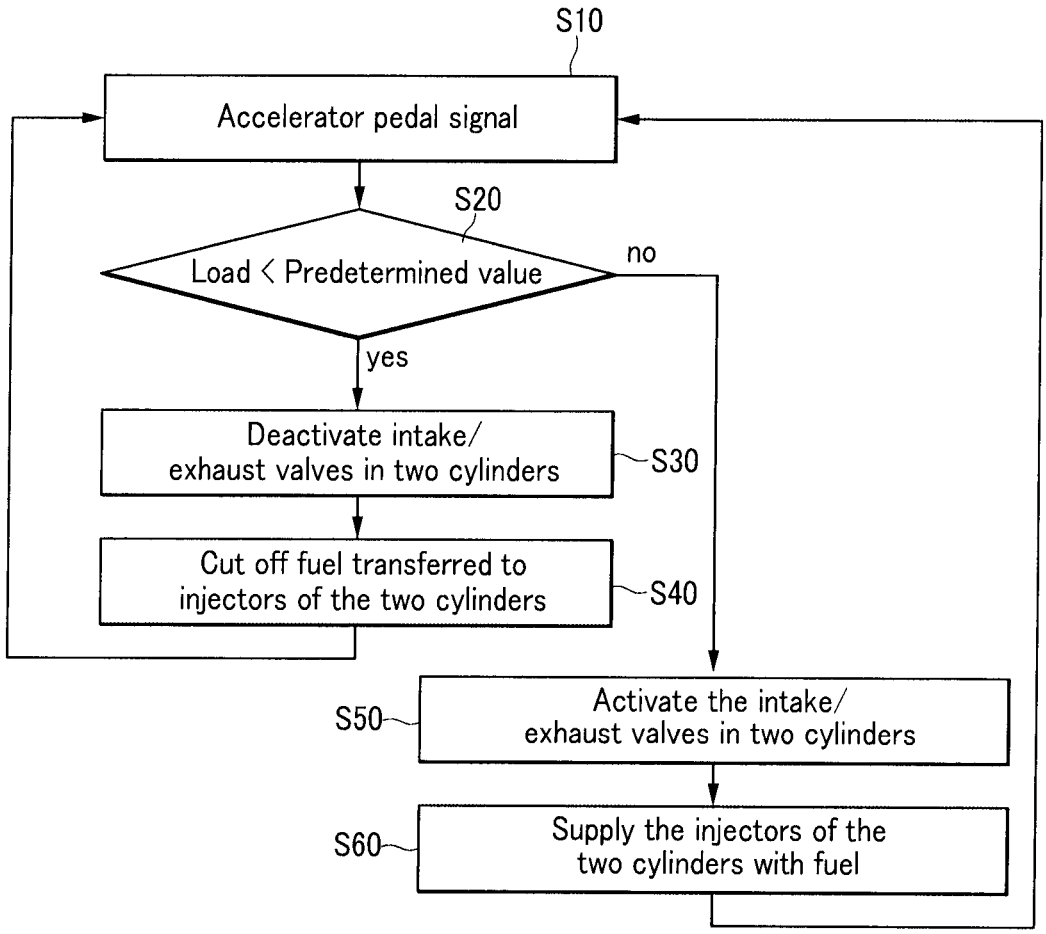
FIG. 6 is a flowchart for controlling an exemplary six-cylinder engine according to the present invention.

FIG. 6 is a flowchart for controlling a six-cylinder engine according to various embodiments of the present invention.

Referring to FIG. 6, an accelerator pedal signal is detected in a first step S10. Here, the pressed amount of the accelerator pedal is detected by a sensor to calculate the accelerator pedal signal.

The load of the engine is calculated based on the accelerator pedal signal in a second step S20. Next, the load is compared with a predetermined value.

When the load is lower than the predetermined value, third and fourth steps (S30 and S40) are executed, and when the load is higher than the predetermined value, fifth and sixth steps (S50 and S60) are executed.

The intake/exhaust valves on the two cylinders are deactivated in the third step S30 and the fuel that is transferred to a fuel injector is cut off in the fourth step S40.

In contrast, the intake/exhaust valves of the deactivated cylinders are operated in the fifth step S50 and the fuel is supplied to the injectors of the two cylinders in the sixth step S60.

As described above, in an exemplary embodiment of the present invention, the first, second, third, and sixth cylinders (1, 2, 3, and 6 cyl) are always activated and the fourth and fifth cylinders (4, 5 cyl) are alternately deactivated or activated corresponding to the load of the engine.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various embodiments of the present invention, as well as various alternatives and modifications thereof. It is intended that the scope of the invention be defined by the Claims appended hereto and their equivalents.

What is claimed is:

1. A multi-cylinder engine with a plurality of cylinders, comprising:

at least one variable cylinder that performs a power stroke or is deactivated;

normal cylinders that perform power strokes at equal rotation intervals; and a control portion that activates or deactivates the at least one variable cylinder according to a predetermined load condition;

wherein deactivation position of the at least one variable cylinder is selected based on rotation angle of a crankshaft;

wherein crankpins of the at least one variable cylinder are symmetrically disposed based on a center axis of the crank shaft;

wherein the variable cylinders and the normal cylinders include a first cylinder, a second cylinder, a third cylinder, a fourth cylinder, a fifth cylinder, and a sixth cylinder;

wherein a first crankpin corresponding to the first cylinder, a second crankpin corresponding to the second cylinder, a third crankpin corresponding to the third cylinder, a fourth crankpin corresponding to the fourth cylinder, a fifth crankpin corresponding to the fifth cylinder, and a sixth crankpin corresponding to the sixth cylinder are disposed; and the first crankpin, the second crankpin, the fourth crankpin, the third crankpin, the sixth crankpin, and the fifth crankpin are disposed sequentially in a rotating direction of the crankshaft with a uniform rotation angle therebetween.

2. The multi-cylinder engine of claim 1, wherein crankpins of the normal cylinders are disposed symmetrically with respect to a line that connects a crankpin of the at least a variable cylinder and a rotation center of the crankshaft.

3. The multi-cylinder engine of claim 2, wherein the crankpins of the normal cylinders and the variable cylinders are disposed approximately with an equal rotation angle therebetween about the rotation center of the crankshaft.

4. The multi-cylinder engine of claim 2, wherein the normal cylinders perform the power strokes symmetrically in time order with respect to the line that connects the crankpins of the variable cylinders and the rotation center of the crankshaft.

5. The multi-cylinder engine of claim 1, wherein the normal cylinders include four cylinders that perform power strokes with equal rotation intervals of 180 degrees in a rotating direction of the crankshaft.

6. The multi-cylinder engine of claim 1, wherein the crankpins of the fourth and fifth cylinders are disposed approximately with 180 degrees therebetween about a rotation center of the crankshaft, wherein the fourth and fifth cylinders are the variable cylinders.

7. The multi-cylinder engine of claim 6, wherein the fourth and fifth cylinders perform power strokes with rotation intervals of 240 degrees in a rotating direction of the crankshaft.

8. The multi-cylinder engine of claim 1, wherein the crankpins of the first, second, third, and sixth cylinders are disposed symmetrically with respect to a line that connects the crankpins of the fourth and fifth cylinders about a rotation center of the crankshaft.

9. The multi-cylinder engine of claim 8, wherein the first cylinder, the sixth cylinder, the second cylinder, and the third cylinder sequentially perform power strokes with equal rotation intervals of 180 degrees, wherein the fifth cylinder and the fourth cylinder are selectively deactivated.

10. The multi-cylinder engine of claim 9, wherein the fifth cylinder performs a power stroke between the power stroke of the first cylinder and the power stroke of the sixth cylinder, and the fourth cylinder performs a power stroke between the power stroke of the sixth cylinder and the power stroke of the second cylinder.

11. The multi-cylinder engine of claim 10, wherein the power stroke of the fifth cylinder has a rotation difference of 60 degrees compared with the power stroke of the first cylinder and the power stroke of the fourth cylinder has a rotation difference of 120 degrees compared with the power stroke of the sixth cylinder.

12. A multi-cylinder engine with a plurality of cylinders, comprising:

a first bank including at least one variable cylinder that performs a power stroke or is deactivated and at least one normal cylinder;

a second bank including at least one variable cylinder that performs a power stroke or is deactivated and at least one normal cylinder; and a control portion that activates or deactivates the at least one variable cylinder according to a predetermined load condition, wherein the normal cylinders perform power strokes at equal rotation intervals, wherein deactivation position of the at least one variable cylinder is selected based on rotation angle of a crankshaft, and wherein crankpins of the at least one variable cylinder are symmetrically disposed based on a center axis of the crank shaft;

wherein the variable cylinders and the normal cylinders include a first cylinder, a second cylinder, a third cylinder, a fourth cylinder, a fifth cylinder, and a sixth cylinder;

wherein a first crankpin corresponding to the first cylinder, a second crankpin corresponding to the second cylinder, a third crankpin corresponding to the third cylinder, a fourth crankpin corresponding to the fourth cylinder, a fifth crankpin corresponding to the fifth cylinder, and a sixth crankpin corresponding to the sixth cylinder are disposed; and wherein the first crankpin, the second crankpin, the fourth crankpin, the third crankpin, the sixth crankpin, and the fifth crankpin are disposed sequentially in a rotating direction of the crankshaft with a uniform rotation angle therebetween.

13. The multi-cylinder engine of claim 12, wherein the crankpins of the fourth and fifth cylinders are disposed approximately with 180 degrees therebetween about a rotation center of the crankshaft, and wherein the fourth and fifth cylinders are the variable cylinders respectively in the first bank and the second bank.

14. The multi-cylinder engine of claim 13, wherein the second and sixth cylinders are disposed in the first bank and the first and fifth cylinders are disposed in the second bank.

15. The multi-cylinder engine of claim 12, wherein the fourth and fifth cylinders perform power strokes with rotation intervals of 240 degrees in a rotating direction of the crankshaft.

* * * * *